US008438819B2

(12) United States Patent
Moreux et al.

(10) Patent No.: US 8,438,819 B2
(45) Date of Patent: May 14, 2013

(54) PROCESS FOR THE PREPARATION OF A PACKAGE CONTAINING COMPACTED COMPOSITION AND THE PACKAGE OBTAINED WITH THIS PROCESS

(75) Inventors: Frederic Moreux, Ludwigshafen (DE); Gunnar Noding, Ludwigshafen (DE); Marion Schleicher, Ludwigshafen (DE)

(73) Assignee: Reckitt Benckiser N.V., WT Hoofddorp (NL)

( * ) Notice: Subject to any disclaimer, the term of this patent is extended or adjusted under 35 U.S.C. 154(b) by 489 days.

(21) Appl. No.: 11/817,911

(22) PCT Filed: Mar. 10, 2006

(86) PCT No.: PCT/GB2006/000865

§ 371 (c)(1),
(2), (4) Date: Nov. 13, 2007

(87) PCT Pub. No.: WO2006/095190

PCT Pub. Date: Sep. 14, 2006

(65) Prior Publication Data

US 2008/0184675 A1 Aug. 7, 2008

(30) Foreign Application Priority Data

Mar. 10, 2005 (GB) ..... 0504919.2
Nov. 4, 2005 (GB) ..... 0522556.0

(51) Int. Cl.
*B65B 51/10* (2006.01)
*B65D 77/00* (2006.01)

(52) U.S. Cl.
USPC ..... 53/463; 53/452; 53/453; 206/216; 264/343

(58) Field of Classification Search ..... 53/452, 53/453, 463; 206/216; 264/343
See application file for complete search history.

(56) References Cited

U.S. PATENT DOCUMENTS

| | | | | |
|---|---|---|---|---|
| 2,545,243 | A | 3/1951 | Rumsey, Jr. | |
| 3,416,649 | A | 12/1968 | Snow, Jr. | |
| 3,587,839 | A | 6/1971 | Forrest | |
| 4,133,431 | A | 1/1979 | Fischer et al. | |
| 4,219,436 | A | 8/1980 | Gromer | |
| 4,828,749 | A | 5/1989 | Kruse et al. | |
| 4,928,813 | A | 5/1990 | Casberg et al. | |
| 5,133,892 | A * | 7/1992 | Chun et al. | 510/224 |
| 6,291,421 | B1 * | 9/2001 | Jacques et al. | 510/515 |
| 2003/0153482 | A1 | 8/2003 | Mumoli | |
| 2003/0224959 | A1 * | 12/2003 | Smith | 510/295 |
| 2004/0023826 | A1 | 2/2004 | Duffield | |
| 2004/0029764 | A1 | 2/2004 | Weber et al. | |
| 2005/0028490 | A1 * | 2/2005 | Wiedemann et al. | 53/452 |
| 2005/0049164 | A1 | 3/2005 | Sommerville-Roberts et al. | |

FOREIGN PATENT DOCUMENTS

| | | | |
|---|---|---|---|
| DE | 10025187 | A1 | 7/2001 |
| DE | 10245260 | A1 | 4/2004 |
| DE | 10254313 | A1 | 6/2004 |
| EP | 0481547 | A | 4/1992 |
| EP | 0688718 | A | 12/1995 |
| GB | 1049212 | A | 11/1966 |
| GB | 2094745 | A | 9/1982 |
| GB | 2244258 | A | 11/1991 |
| GB | 2330362 | A * | 4/1999 |
| JP | 2004155019 | A | 6/2004 |
| WO | 9216431 | A | 10/1992 |
| WO | 9217382 | A | 10/1992 |
| WO | 9700282 | A | 1/1997 |
| WO | WO03/072694 | A1 * | 9/2003 |
| WO | WO2004/096643 | A1 * | 11/2004 |

OTHER PUBLICATIONS

Patent Abstract of Japan vol. 2003, No. 12, Dec. 5, 2003.

* cited by examiner

*Primary Examiner* — Bijan Ahvazi
(74) *Attorney, Agent, or Firm* — Norris, McLaughlin & Marcus PA

(57) ABSTRACT

A process for the preparation of a package containing a compacted particulate composition, comprises wrapping a compacted particulate composition with a first film and treating the wrapped compacted particulate composition at an elevated temperature to shrink the film such that it clings to said composition. The resulting packages may be made using low compaction pressures and consequently may have low friability and be fast dissolving.

12 Claims, No Drawings

PROCESS FOR THE PREPARATION OF A PACKAGE CONTAINING COMPACTED COMPOSITION AND THE PACKAGE OBTAINED WITH THIS PROCESS

This is an application filed under 35 USC 371 of PCT/GB2006/000865.

The present invention relates to a process for the preparation of a water-soluble package containing a compacted particulate composition.

Tablets of a compressed particulate composition for use in dishwashing machines or laundry washing machines are well known. Such tablets are added to the machine at the start of its operation and are fully consumed by the end of the operation. Examples of such tablets are dishwashing tablets such as those sold under the trade mark Finish, water-softening tablets such as those sold under the trade mark Calgon, and laundry detergent tablets such as those sold under the trade mark Persil.

Such tablets are fairly fragile, and liable to break, fracture or chip, particularly when dropped onto the floor by a consumer, or when a package containing them falls from a high shelf when being stored in, for example, a warehouse or supermarket. It is possible to improve the strength of tablets by increasing the pressure at which they are compressed, but this can undesirably retard their dissolution when they are used.

There is almost always a complex interplay of factors in developing products of this type. There is often a compromise between the hardness of a tablet, and thus its durability, its friability, how easily it will chip or flake, and the dissolution time. In producing compacted particulate compositions the choice of ingredients can also be constrained; the use of too much organic material often leads to a slow solubilising product and large amounts of crystalline ingredients may need a binder added. In any event at least one disintegrating agent is usually needed, such as hydrated water-soluble salts (for example sodium acetate trihydrate), swelling agents (for example amorphous cellulose) or wicking agents (for example microcrystalline cellulose) to draw water into the solid. The use of disintegrating/binding agents, or any tabletting aid, adds to the cost of the tablet.

Most tablets are wrapped in a material prior to packaging, such as blister packs, or foil wrapped into individual sachets. Often the wrapping is needed for any one or more of the following reasons: (1) to act as a physical barrier, so as to protect the contents from moisture; (2) to physically protect the contents such that if they fracture, the broken tablet does not contaminate the primary packaging; (3) to act as a child resistant closure.

Packaging of tablets is known in the art. For example, U.S. Pat. No. 4,133,431 discloses a stack of brittle tablets shrink wrapped with rigid separator and indicator elements between each tablet group and at the ends of the stack. U.S. Pat. No. 4,928,813 discloses a capsule comprising a tablet section having at least one chlorine compound tablet and a shell securely fitted around the tablet section. The shell has two apertures at opposite ends, each extension extending away from the tablet section and having a conduit communicating with an aperture to reduce the dissolution rate of the chlorine into the water.

DE 10025187 discloses tablets that are packed in foil bags set in an outer packaging formed by a non-self supporting wrapping. The wrapping can be made of paper or plastics such as shrink fit foil and need only surround the foil bag in parts. DE 10254313 discloses moulded detergent products with at least one cavity with film sealing the openings in which the film surrounds the moulding as a sleeve or cover. JP 2004 155019 A discloses a hard chloroethylene resin sheet which is subjected to vacuum forming or pressure forming to form a packaging sheet.

DE 10245260 A1 discloses the production of detergent portions in closely fitting water-soluble packaging. The production process comprises 1) laying a water-soluble base film on a conveyor chain or mold, 2) applying the portion to the base film, 3) laying a film on top, 4) adjusting the films to enclose the portion and 5) sealing and optionally cutting the films.

We have discovered a process for packaging compacted particulate compositions by which the resistance of the composition to physical damage is surprisingly increased. One of the main advantages is that a wider range of physical properties of the compacted particulate composition can be tolerated, such as reduced hardness and increased friability, thus allowing a wider window of ingredient selection and manufacturing tolerances. Consequently there is an opportunity to offer a compacted particulate composition which has fast dissolution in water.

The present invention provides a process for the preparation of a package containing a compacted particulate composition, comprising:

a. wrapping a compacted particulate composition with a first film;

b. treating the wrapped compacted particulate composition at an elevated temperature to shrink the film such that it clings to said composition.

Preferably step a. employs flow wrapping.

It has been found that the process of the invention offers a simple method of intimately wrapping a compacted particulate composition.

It is to be understood that extruded and injected moulded compositions are to be classed as compacted particulate compositions Surprisingly the wrapped compositions do not easily fracture or chip, even when packaged together in a secondary package. Thus the film does not function merely to hold fractured tablets together; instead it prevents fracturing from occurring so that the tablet retains its structural integrity. This has the effect that a smaller amount of binder (commonly used in compacted particulate compositions) can be used without compromising on their integrity; and/or that a lower compaction pressure can be used; and/or that a compacted particulate composition of modest or even poor inherent mechanical properties may be used, protected and/or retained by the wrapping; and/or that a fast-dissolving product can be made.

Preferably the package is readily soluble in water.

Furthermore, fast-dissolving compacted particulate compositions can be made in accordance with the invention, using a reduced compaction pressure. For example a 20 g tablet of fast-dissolving type made in accordance with the present invention may dissolve in water at 40° C. under standard test conditions of agitation as mentioned in the examples hereinafter, in less than 10 minutes, preferably in less than 5 minutes. Preferably these dissolution rates may be achieved by all known agitation methods used in dishwasher tablet dissolution testing.

In an alternative, simple definition a 20 g tablet may be immersed in 800 ml of tap water at 40° C., in a 1 litre cylindrical beaker, which is then agitated (which may include swirling) by grasping the beaker by hand and/or by a hand-held tool immersed in the water but not permitted to come into contact with the tablet, the resulting agitation being to the maximum extent possible without causing water to spill from the beaker. Under these conditions tablets of the present invention preferably dissolve in less than 10 minutes, preferably less than 5 minutes.

Generally flow wrapping comprises sealing peripheral regions of a web of film around an object to form a tube with a longitudinal seam. The two ends of the tube are sealed around the product being packaged by transverse seams. In forming the transverse seams the longitudinal seam is brought next to the surface of the packaged product and is normally disposed in the middle of the rear face of the packaging.

As an illustration WO-A-92/16431 discloses a tubular sachet pack, comprising a web of film having a composite structure. The opposite peripheral regions of the film are sealed to form a tube having a longitudinal seam. The tube is sealed about the object to be packaged by two parallel transverse seams. The longitudinal flap seam is disposed along the middle of the pack, flush with the surface.

This method of wrapping compacted particulate compositions with a film of material is straightforward and economical, when compared to, for example, dipping or spray coating.

The film is preferably sealed together in a known manner. Sealing can simply occur under the forming conditions used in the process of the present invention, particularly when heat and/or pressure are used. However, it is also possible for additional sealing techniques to be used. For example, heat sealing or infra-red, radio frequency, ultrasonic, laser, solvent, adhesive, vibration, electromagnetic, hot gas, hot plate or insert bonding friction sealing, cold sealing or spin welding can be used. Heat sealing is preferred.

Heat sealing conditions depend on the machine and material used. Generally the sealing temperature is from 100 to 180° C. The pressure is usually from 100 to 500 kPa (1 to 5 bar). The dwell time is generally from 0.02 to 0.6 seconds.

The heat treatment step (b) is preferably carried out over a short timescale to avoid thermal damage to the film and/or the compacted particulate composition. It will be appreciated that the amount of time required for this step will be dependent on the thickness of the film being used.

Generally the heat treatment step is carried out in a time of 0.1 to 5 seconds, more preferably 0.2 to 4 seconds, more preferably 0.5 to 2 seconds, more preferably 1.0 to 2.0 seconds, e.g. about 1.5 seconds.

Most preferably the heat treatment step is carried out in a zone through which the wrapped composition is conveyed. In this way it has been found that the heat treatment step may form part of a production process for a wrapped compacted particulate composition wherein the process includes other steps, such as the compaction of the composition. Such processes generally operate at around 1500 individual compacted particulate compositions per minute on a single operational line. It has been found that advantageously the process of the present invention is able to work with this rate of throughput.

Generally the zone comprises a flow (e.g. in the form of jets) of hot air over the wrapped compacted particulate compositions. Preferably a plurality of jets of hot air are passed over the wrapped composition. For example a jet of air may be directed at the composition from above, a jet of air may be directed at the composition from below and a jet of air may be directed at one or more sides of the composition. In order that multiple jets of air may be directed at the wrapped composition preferably the composition is carried on an apertured conveyor through the zone.

It will be understood that the temperature of the jets of air will depend upon the nature of the wrapped composition (particularly if the composition is thermally sensitive) and the film, material being used. Generally the air is heated to a temperature of between 90 to 950° C., more preferably 140 to 800° C., more preferably 180 to 650° C.

It will be appreciated that the film temperature may be lower than the temperature of the air jet. Most preferably the film temperature is between 80 to 220° C. and more preferably 120 to 180° C.

Generally the film has an aperture to allow the release of any trapped air during the heating process. Most preferably the film (when applied to the compacted particulate composition) has a plurality of apertures. Preferably the apertures are disposed on the upper surface of the particulate composition. Usually the apertures are applied using a punch. The apertures have a preferred size (before the heat treatment step) of from around 0.1 to 0.3 mm.

A cooling step has been found to be only optional rather than a requisite.

In the process the thickness of the film which is preferably 10 to 2000 μm, especially 10 to 150 μm and more especially 15 to 80 μm. These measurements are before heat treatment; after heat treatment some of the film may have a different thickness, particularly around corners.

Desirably the film is water soluble, which term is taken to include water-dispersible. The package is also preferably water-soluble. A water soluble film allows the product of the process of the invention to be dispersed in an aqueous medium without having to be unwrapped.

Preferably the film comprises a polymeric material.

Examples of water-soluble polymers are PVOH, cellulose derivatives such as hydroxypropyl methyl cellulose (HPMC), gelatin, poly(vinylpyrrolidone), poly(acrylic acid) or an ester thereof or poly(maleic acid) or an ester thereof. Copolymers of any of these polymers may also be used.

An example of a preferred PVOH is an esterified or etherified PVOH. The PVOH may be partially or fully alcoholised or hydrolysed. For example it may be from 40 to 100%, preferably from 70 to 92%, more preferably about 88% or about 92%, alcoholised or hydrolysed. The degree of hydrolysis is known to influence the temperature at which the PVOH starts to dissolve in water. 88% hydrolysis corresponds to a PVOH soluble in cold (i.e. room temperature) water, whereas 92% hydrolysis corresponds to a PVOH soluble in warm water.

By choosing an appropriate water-soluble polymer it is possible to ensure that it dissolves at a desired temperature. Thus the film may be cold water (20° C.) soluble, but may be insoluble in cold water and only become soluble in warm or hot water having a temperature of, for example, 30° C., 40° C., 50° C. or even 60° C.

Desirably the film consists essentially of, or consists of, the polymer composition. It is possible for suitable additives such as plasticisers, lubricants and colouring agents to be added. A particularly attractive appearance can be achieved by having the films in different colours, or by having one film uncoloured and the other coloured. Components which modify the properties of the polymer may also be added. Plasticisers are generally used in an amount of up to 20 wt %, for example from 5 to 20 wt % or 10 to 20 wt %. Lubricants are generally used in an amount of 0.5 to 5 wt %. The polymer is therefore generally used in an amount of from 75 to 94.5 wt %, based on the total amount of the moulding composition. Suitable plasticisers are, for example, water, pentaerythritols such as depentaerythritol, sorbitol, mannitol, glycerine and glycols such as glycerol, ethylene glycol and polyethylene glycol. Solids such as talc, stearic acid, magnesium stearate, silicon dioxide, zinc stearate or colloidal silica may be used as lubricants.

It is also possible to include one or more particulate solids in the films in order to accelerate the rate of dissolution of the film. Dissolution of the solid in water is sufficient to cause an acceleration in the break-up of the film, particularly if a gas is generated.

Examples of such solids are alkali and alkaline earth metal, such as sodium, potassium, magnesium and calcium, bicarbonate and carbonate, in conjunction with an acid. Suitable acids are, for example acidic substances having carboxylic or sulfonic acid groups or salts thereof. Examples are cinnamic, tartaric, mandelic, fumaric, maleic, malic, palmoic, citric and naphthalene disulfonic acids, as free acids or as their salts, for example with alkali or alkaline earth metals.

The film may be a single film, or a laminated film as disclosed in GB-A-2,244,258. The layers in a film laminate may be the same or different. Thus the layers may each comprise the same polymer or a different polymer.

The film may be produced by any process, for example by extrusion and blowing or by casting. The film may be unoriented, monoaxially oriented or biaxially oriented. If the layers in the film are oriented, they usually have the same orientation, although their planes of orientation may be different if desired.

The process of the present invention covers or wraps a tablet of a compressed particulate composition in a film. The tablet may be a conventional tablet of the type which is already known. It is postulated, although again the applicant is not bound by this theory, that the increased strength of the tablet arises from the interaction of the outer polymer film and the surface of the tablet and/or compression of the tablet by the outer film.

The compacted particulate composition is formed by compressing a particulate composition. The particles may, if desired, be treated before they are compressed, for example by agglomeration and/or granulation. The composition before it is compressed may, for example, have a mean particle size of from 100 to 2000 μm, preferably 200 to 1200 μm.

The compacted particulate composition may be compressed at a compression pressure of, for example, from 50 to 1000 kg/cm$^2$, preferably from 60 to 300 kg/cm$^2$ for laundry tablets or from 50 to 1000 kg/cm$^2$, more preferably from 100 to 700 kg/cm$^2$, for dishwashing tablets. For dishwashing tablets having good inherent mechanical properties preferred ranges may be 400 to 1000 kg/cm$^2$, more preferably from 500 to 700 kg/cm$^2$. For dishwashing tablets having poorer inherent mechanical properties and/or especially fast dissolution properties preferred ranges may be 150-400 kg/cm$^2$, preferably 160-350 kg/cm$^2$, most preferably 170-300 kg/cm$^2$. These definitions refer to nominal compression forces which one would set on the particular tablet press being used for making the tablets. The stipulation is that on any given press which is in use the nominal compression force should be within one or more of the ranges stated above.

Suitably the compacted particulate composition part of the package, that is the unwrapped core, is highly friable. Preferably the package is not friable.

Standard tests are available for friability including one which follows in the examples. In accordance with this aspect of the invention the difference between "non-friable" and "highly friable" is so marked—as shown in later examples that further definition is not thought necessary.

Preferably the compacted particulate composition part of the package of the present invention is softer than conventional compacted particulate compositions. The latter typically have hardness values in the range 230-260 N. Preferably the compacted particulate composition part of the package of the present invention has a hardness value not exceeding 200 N, preferably not exceeding 150 N. Preferably the compacted particulate composition part of the package of the present invention has a hardness value of at least 80 N, preferably at least 100 N. For the purpose of these definitions the hardness testing may be as determined across the width of a standard shaped cuboid 20 g unwrapped tablet, tested to destruction, using an ERWEKA tablet hardness tester THB30. In this tester the tablet is set on a generally L-shaped support, against the upwardly projecting limb thereof. A circular piston of 8 mm diameter is advanced at a rate of 30 mm per minute and pressed onto the central region of the respective side wall, until the tablet is broken.

Alternatively the hardness definitions herein may be regarded as being such that they must be satisfied by all hardness testing equipment/regimens used for testing dishwashing tablets.

Preferably the compacted particulate composition part of the package of the present invention is able to help its shape in the absence of applied stresses but is quickly degraded by applied stresses. Shear stresses may readily cause it to flake and crumble. Compressive stresses may readily cause it to be crushed. However the provision of a heat-shrunk water-soluble wrapper obviates these defects, permits clean handling, and allows the major benefit of fast dissolution to be exploited.

The compacted composition may be of any shape or form. It is most desirably in the form of a tablet. It may, for example, be in the form of a cuboid, cylinder or prism. It may also comprise a single particulate composition or two, three or even more compositions. For example, the compacted particulate composition may comprise two, three or more layers.

The packages may contain one or more than one compacted particulate composition. If the packages contain two or more compositions, they can have a particularly attractive appearance since the compositions, which may be identical or different, may be held in a fixed position in relation to each other. The compositions can be easily differentiated to accentuate their difference. For example, the compositions can have a different physical appearance, or can be coloured differently.

The packages may have any desired shape. The shape of the outside of the packages follows the shape of the packaged composition. For example the package can have a irregular or regular geometrical shape such as a cube, cuboid, pyramid, dodecahedron or cylinder. The cylinder may have any desired cross-section, such as a circular, triangular or square cross-section.

If the composition has two or more phases, the individual phases need not necessarily be regular or identical. For example, if the final composition has a cuboid shape, the individual phases may have different sizes to accommodate different quantities of compositions.

The compacted particulate composition may also, for example, comprise an insert, which may be held in a depression within the compact. The insert may also stand proud of the compact. For example, the compacted particulate composition may be in the form of a tablet, especially a cuboid tablet, comprising one, two or more layers, and an insert, for example in the form of a ball in a mould. An example of such a tablet is that sold under the trade mark Finish by Reckitt Benckiser plc.

The composition(s) which can be held in the package, or in each phase in the composition held in the package, may independently be a fabric care, surface care or dishwashing composition. Thus, for example, they may be a dishwashing, water-softening, laundry or detergent composition, or a rinse aid. Such compositions may be suitable for use in a domestic washing machine. The compositions may also independently be a disinfectant, antibacterial or antiseptic composition, or a refill composition for a trigger-type spray. Such compositions are generally packaged in total amounts of from 5 to 100 g, especially from 5 to 40 g. For example, a laundry composition may weigh from 15 to 40 g, a dishwashing composition may weigh from 5 to 30 g and a water-softening composition may weigh from 15 to 40 g.

The phases may have the same or different size and/or shape. In general, if it is desired to have phases containing different quantities of components, the phases have volume ratios of from 1:1 to 20:1, especially from 1:1 to 10:1.

The packages produced by the process of the present invention may, if desired, have a maximum dimension of 10 cm, excluding any flanges. For example, a container may have a length of 1 to 5 cm, especially 3.5 to 4.5 cm, a width of 1.5 to 3.5 cm, especially 2 to 3 cm, and a height of 1 to 3 cm, especially 1.0 to 2.0 cm, e.g. 1.8 cm.

If more than one composition is present, the compositions may be appropriately chosen depending on the desired use of the article.

If the article is for use in laundry washing, the primary composition may comprise, for example, a detergent, and the secondary composition may comprise a bleach, stain remover, water-softener, enzyme or fabric conditioner. The article is adapted to release the compositions at different times during the laundry wash. For example, a bleach or fabric conditioner is generally released at the end of a wash, and a water-softener is generally released at the start of a wash. An enzyme may be released at the start or the end of a wash.

If the article is for use as a fabric conditioner, the primary composition may comprise a fabric conditioner and the secondary component may comprise an enzyme which is released before or after the fabric conditioner in a rinse cycle.

If the article is for use in dishwashing the primary composition may comprise a detergent and the secondary composition may comprise a water-softener, salt, enzyme, rinse aid, bleach or bleach activator. The article is adapted to release the compositions at different times during the laundry wash. For example, a rinse aid, bleach or bleach activator is generally released at the end of a wash, and a water-softener, salt or enzyme is generally released at the start of a wash.

Examples of surface care compositions are those used in the field of surface care, for example to clean, treat or polish a surface. Suitable surfaces are, for example, household surfaces such as worktops, as well as surfaces of sanitary ware, such as sinks, basins and lavatories.

The ingredients of each composition depend on the use of the composition. Thus, for example, the composition may contain surface active agents such as an anionic, non-ionic, cationic, amphoteric or zwitterionic surface active agents or mixtures thereof.

Examples of anionic surfactants are straight-chained or branched alkyl sulfates and alkyl polyalkoxylated sulfates, also known as alkyl ether sulfates. Such surfactants may be produced by the sulfation of higher $C_8$-$C_{20}$ fatty alcohols.

Examples of primary alkyl sulfate surfactants are those of formula:

$$ROSO_3^-M^+$$

wherein R is a linear $C_8$-$C_{20}$ hydrocarbyl group and M is a water-solubilising cation. Preferably R is $C_{10}$-$C_{16}$ alkyl, for example $C_{12}$-$C_{14}$, and M is alkali metal such as lithium, sodium or potassium.

Examples of secondary alkyl sulfate surfactants are those which have the sulfate moiety on a "backbone" of the molecule, for example those of formula:

$$CH_2(CH_2)_n(CHOSO_3^-M^+)(CH_2)_mCH_3$$

wherein m and n are independently 2 or more, the sum of m+n typically being 6 to 20, for example 9 to 15, and M is a water-solubilising cation such as lithium, sodium or potassium.

Especially preferred secondary alkyl sulfates are the (2,3) alkyl sulfate surfactants of formulae:

$$CH_2(CH_2)_x(CHOSO_3^-M^+)CH_3 \text{ and}$$

$$CH_3(CH_2)_x(CHOSO_3^-M^+)CH_2CH_3$$

for the 2-sulfate and 3-sulfate, respectively. In these formulae x is at least 4, for example 6 to 20, preferably 10 to 16. M is cation, such as an alkali metal, for example lithium, sodium or potassium.

Examples of alkoxylated alkyl sulfates are ethoxylated alkyl sulfates of the formula:

$$RO(C_2H_4O)_nSO_3^-M^+$$

wherein R is a $C_8$-$C_{20}$ alkyl group, preferably $C_{10}$-$C_{18}$ such as a $C_{12}$-$C_{16}$, n is at least 1, for example from 1 to 20, preferably 1 to 15, especially 1 to 6, and M is a salt-forming cation such as lithium, sodium, potassium, ammonium, alkylammonium or alkanolammonium. These compounds can provide especially desirable fabric cleaning performance benefits when used in combination with alkyl sulfates.

The alkyl sulfates and alkyl ether sulfates will generally be used in the form of mixtures comprising varying alkyl chain lengths and, if present, varying degrees of alkoxylation.

Other anionic surfactants which may be employed are salts of fatty acids, for example $C_8$-$C_{18}$ fatty acids, especially the sodium or potassium salts, and alkyl, for example $C_8$-$C_{18}$, benzene sulfonates.

Examples of non-ionic surfactants are fatty acid alkoxylates, such as fatty acid ethoxylates, especially those of formula:

$$R(C_2H_4O)_nOH$$

wherein R is a straight or branched $C_8$-$C_{16}$ alkyl group, preferably a $C_9$-$C_{15}$, for example $C_{10}$-$C_{14}$, alkyl group and n is at least 1, for example from 1 to 16, preferably 2 to 12, more preferably 3 to 10.

The alkoxylated fatty alcohol non-ionic surfactant will frequently have a hydrophilic-lipophilic balance (HLB) which ranges from 3 to 17, more preferably from 6 to 15, most preferably from 10 to 15.

Examples of fatty alcohol ethoxylates are those made from alcohols of 12 to 15 carbon atoms and which contain about 7 moles of ethylene oxide. Such materials are commercially marketed under the trademarks Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$-$C_{13}$ alcohol having about 9 moles of ethylene oxide; and Neodol 91-10, an ethoxylated $C_9$-$C_{11}$ primary alcohol having about 10 moles of ethylene oxide.

Alcohol ethoxylates of this type have also been marketed by Shell Chemical Company under the Dobanol trademark. Dobanol 91-5 is an ethoxylated $C_9$-$C_{11}$ fatty alcohol with an average of 5 moles ethylene oxide and Dobanol 25-7 is an ethoxylated $C_{12}$-$C_{15}$ fatty alcohol with an average of 7 moles of ethylene oxide per mole of fatty alcohol.

Other examples of suitable ethoxylated alcohol non-ionic surfactants include Tergitol 15-S-7 and Tergitol 15-S-9, both of which are linear secondary alcohol ethoxylates available from Union Carbide Corporation. Tergitol 15-S-7 is a mixed ethoxylated product of a $C_{11}$-$C_{15}$ linear secondary alkanol with 7 moles of ethylene oxide and Tergitol 15-S-9 is the same but with 9 moles of ethylene oxide.

Other suitable alcohol ethoxylated non-ionic surfactants are Neodol 45-11, which is a similar ethylene oxide condensation products of a fatty alcohol having 14-15 carbon atoms and the number of ethylene oxide groups per mole being about 11. Such products are also available from Shell Chemical Company.

Further non-ionic surfactants are, for example, $C_{10}$-$C_{18}$ alkyl polyglycosides, such as $C_{12}$-$C_{16}$ alkyl polyglycosides, especially the polyglucosides. These are especially useful when high foaming compositions are desired. Further surfactants are polyhydroxy fatty acid amides, such as $C_{10}$-$C_{18}$N-(3-methoxypropyl) glycamides and ethylene oxide-propylene oxide block polymers of the Pluronic type.

Examples of cationic surfactants are those of the quaternary ammonium type.

The compositions, particularly when used as laundry washing or dishwashing compositions, may also independently comprise enzymes, such as protease, lipase, amylase, cellulase and peroxidase enzymes. Such enzymes are commercially available and sold, for example, under the registered trade marks Esperase, Alcalase and Savinase by Nova Industries A/S and Maxatase by International Biosynthetics, Inc. Desirably the enzymes are independently present in the compositions in an amount of from 0.01 to 3 wt %, especially 0.01 to 2 wt %, when added as commercial preparations they are not pure and this represents an equivalent amount of 0.005 to 0.5 wt % of pure enzyme.

Compositions used in dishwashing independently usually comprise a detergency builder. The builders counteract the effects of calcium, or other ion, water hardness. Examples of such materials are citrate, succinate, malonate, carboxymethyl succinate, carboxylate, polycarboxylate and polyacetyl carboxylate salts, for example with alkali metal or alkaline earth metal cations, or the corresponding free acids. Specific examples are sodium, potassium and lithium salts of oxydisuccinic acid, mellitic acid, benzene polycarboxylic acids, $C_{10}$-$C_{22}$ fatty acids and citric acid. Other examples are organic phosphonate type sequestering agents such as those sold by Monsanto under the trade mark Dequest and alkylhydroxy phosphonates. Citrate salts and $C_{12}$-$C_{18}$ fatty acid soaps are preferred. Further builders are; phosphates such as sodium, potassium or ammonium salts of mono-, di- or tripoly or oligo-phosphates; zeolites; silicates, amorphous or structured, such as sodium, potassium or ammonium salts.

Other suitable builders are polymers and copolymers known to have builder properties. For example, such materials include appropriate polyacrylic acid, polymaleic acid, and polyacrylic/polymaleic and copolymers and their salts, such as those sold by BASF under the trade mark Sokalan. The builder is desirably present in an amount of up to 90 wt %, preferably 0.01 to 90 wt %, more preferable 0.01 to 75 wt %, relative to the total weight of the composition. Further details of suitable components are given in, for example, EP-A-694,059, EP-A-518,720 and WO 99/06522.

The compositions can also optionally comprise one or more additional ingredients. These include conventional detergent composition components such as further surfactants, bleaches, bleach enhancing agents, builders, suds boosters or suds suppressors, anti-tarnish and anti-corrosion agents, organic solvents, co-solvents, phase stabilisers, emulsifying agents, preservatives, soil suspending agents, soil release agents, germicides, pH adjusting agents or buffers, non-builder alkalinity sources, chelating agents, clays such as smectite clays, enzyme stabilizers, anti-limescale agents, colourants, dyes, hydrotropes, dye transfer inhibiting agents, brighteners, and perfumes. If used, such optional ingredients may constitute up to 60 wt %, for example from 1 to 50 wt %, the total weight of the compositions.

Compositions which comprise an enzyme may optionally contain materials which maintain the stability of the enzyme. Such enzyme stabilizers include, for example, polyols such as propylene glycol, boric acid and borax. Combinations of these enzyme stabilizers may also be employed. If utilized, the enzyme stabilizers generally constitute from 0.01 to 2 wt % of the compositions.

The compositions may optionally comprise materials which serve as phase stabilizers and/or co-solvents. Examples are $C_1$-$C_3$ alcohols such as methanol, ethanol and propanol. $C_1$-$C_3$ alkanolamines such as mono-, di- and triethanolamines can also be used, by themselves or in combination with the alcohols. The phase stabilizers and/or co-solvents can, for example, constitute 0 to 1 wt %, preferably 0.1 to 0.5 wt %, of the composition.

The compositions may optionally comprise components which adjust or maintain the pH of the compositions at optimum levels. The pH may be from, for example, 1 to 13, such as 8 to 11 depending on the nature of the composition. For example a dishwashing composition desirably has a pH of 8 to 11, a laundry composition desirable has a pH of 7 to 9, and a water-softening composition desirably has a pH of 7 to 9. Examples of pH adjusting agents are soda ash ($Na_2CO_3$) and citric acid.

The above examples may be used for dish or fabric washing. In particular dish washing formulations are preferred which are adapted to be used in automatic dish washing machines. Due to their specific requirements specialised formulation is required and these are illustrated below Amounts of the ingredients can vary within wide ranges, however preferred automatic dishwashing detergent compositions herein (which typically have a 1% aqueous solution pH of above 7, more preferably from 8 to 12, most preferably from 8 to 10.5) are those wherein there is present: from 5% to 90%, preferably from 5% to 75%, of builder; from 0.1% to 40%, preferably from 0.5% to 30%, of bleaching agent; from 0.1% to 15%, preferably from 0.2% to 10%, of the surfactant system; from 0.0001% to 1%, preferably from 0.001% to 0.05%, of a metal-containing bleach catalyst; and from 0.1% to 40%, preferably from 0.1% to 20% of a water-soluble silicate. Such fully-formulated embodiments typically further comprise from 0.1% to 15% of a polymeric dispersant, from 0.01% to 10% of a chelant, and from 0.00001% to 10% of a detersive enzyme, though further additional or adjunct ingredients may be present. Detergent compositions herein in granular form typically limit water content, for example to less than 7% free water, for better storage stability.

Non-ionic surfactants useful in ADW (Automatic Dish Washing) compositions of the present invention desirably include surfactant(s) at levels of up to 15% of the composition. In general, bleach-stable surfactants are preferred. Non-ionic surfactants generally are well known, being described in more detail in Kirk Othmer's Encyclopedia of Chemical Technology, 3rd Ed., Vol. 22, pp. 360-379, "Surfactants and Detersive Systems", incorporated by reference herein.

Preferably the ADW composition comprises at least one non-ionic surfactant. One class of non-ionics are ethoxylated non-ionic surfactants prepared by the reaction of a monohydroxy alkanol or alkylphenol with 6 to 20 carbon atoms with preferably at least 12 moles particularly preferred at least 16 moles, and still more preferred at least 20 moles of ethylene oxide per mole of alcohol or alkylphenol.

Particularly preferred non-ionic surfactants are the non-ionic from a linear chain fatty alcohol with 16-20 carbon atoms and at least 12 moles particularly preferred at least 16 and still more preferred at least 20 moles of ethylene oxide per mole of alcohol.

According to one preferred embodiment the non-ionic surfactant additionally comprise propylene oxide units in the molecule. Preferably this PO units constitute up to 25% by weight, preferably up to 20% by weight and still more preferably up to 15% by weight of the overall molecular weight of the non-ionic surfactant. Particularly preferred surfactants are ethoxylated mono-hydroxy alkanols or alkylphenols, which additionally comprises polyoxyethylene-polyoxypropylene block copolymer units. The alcohol or alkylphenol portion of such surfactants constitutes more than 30%, preferably more than 50%, more preferably more than 70% by weight of the overall molecular weight of the non-ionic surfactant.

Another class of non-ionic surfactants includes reverse block copolymers of polyoxyethylene and polyoxypropylene and block copolymers of polyoxyethylene and polyoxypropylene initiated with trimethylolpropane.

Another preferred non-ionic surfactant can be described by the formula:

$$R^1O[CH_2CH(CH_3)O]_x[CH_2CH_2O]_y[CH_2CH(OH)R^2]$$

wherein $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

wherein $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. H, methyl or ethyl are particularly preferred, for the group $R^3$. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different non-ionic surfactants is particularly preferred in ADW formulations for example mixtures of alkoxylated alcohols and hydroxy group containing alkoxylated alcohols.

The packages may themselves be packaged in outer containers if desired, for example non-water soluble containers which are removed before the water-soluble packages are used.

In use one or more packages are simply added to water where the outside dissolves. Thus they may be added in the usual way to a dishwasher or laundry machine, especially in the dishwashing compartment or a drum. They may also be added to a quantity of water, for example in a bucket or trigger-type spray.

In accordance with a second aspect of the invention there is provided a package as described above, having a heat-shrunk film around a compacted particulate ware-washing, preferably dishwashing, composition.

In accordance with a third aspect of the invention there is provided a package as described above, having a heat-shrunk film around a lightly compacted particulate ware-washing, preferably dishwashing, composition.

In accordance with a fourth aspect of the invention there is provided comprising a package comprising a compacted particulate composition wrapped in a water soluble wrapper, the compacted particulate composition being compacted at a compaction pressure in the range 150-400 kg/cm$^2$.

In accordance with a fifth aspect of the invention there is provided package comprising a compacted particulate composition wrapped in a water soluble wrapper, the package being non-friable but the compacted particulate composition itself being highly friable.

In accordance with a sixth aspect of the invention there is provided package comprising a compacted particulate composition having a hardness not exceeding 200 N, as determined across the width of a 20 g cuboid compacted particulate composition measuring 37 mm by 27 mm by 14 mm. By across the width we mean that the compression force is applied to the sides which are of size 37 mm by 14 mm.

Preferably the package of any of the second, third, fourth, fifth or sixth aspects is made by a process of the first aspect.

Preferred packages of the invention satisfy the condition stipulated in the second aspect in combination with any one of more of the third, fourth, fifth or sixth aspects; or any other definition of a preferred product or process of any aspect of the invention given herein.

The invention will now be further described by way of example. In this example of the present invention a 28 μm thickness PVOH film was flow-wrapped and heat shrunk onto a compressed particulate dishwashing tablet comprising surfactants, builders, enzymes and auxiliary agents; all typical ADW raw materials. The tablet was compressed with a compression force of 230 kg/cm$^2$ in a standard rotary tablet press.

The resulting tablet, naked and wrapped, was assessed for hardness, friability and dissolution time in comparison with a corresponding heavily compressed naked tablet (compressive force 700 kg/cm$^2$).

The results are set out in Table 1 below.

TABLE 1

| Tablets | | Hardness in N | Dissolution Time in Min | Tab weight before Friability test in g | Tab weight after Friability test in g | Friability in % in % |
|---|---|---|---|---|---|---|
| Unwrapped | | | | | | |
| Hard | | 250 | 10.75 | 21.08 | 19.93 | 5.46 |
| (comparison) | | 244 | 12.00 | 21.17 | 19.77 | 6.61 |
| | Average | 247 | 11.38 | 21.13 | 19.85 | 6.04 |
| Soft | | 136 | 3.00 | 21.12 | 4.87 | 76.94 |
| (comparison) | | 133 | 3.25 | 20.89 | 5.76 | 72.43 |
| | Average | 134.5 | 3.13 | 21.01 | 5.32 | 74.69 |
| Wrapped | | | | | | |
| Hard | | 235 | 10.92 | 21.43 | 21.39 | 0.19 |
| (invention) | | 248 | 12.00 | 21.48 | 21.47 | 0.05 |
| | Average | 241.5 | 11.46 | 21.46 | 21.43 | 0.12 |
| Soft | | 145 | 2.83 | 21.27 | 21.26 | 0.05 |
| (invention) | | 135 | 3.00 | 21.31 | 21.30 | 0.05 |
| | Average | 140 | 2.92 | 21.29 | 21.28 | 0.05 |

The Hardness testing used a ERWEKA tablet hardness tester THB 30. Standard shaped cuboid 20 g tablets, of size 37 mm by 27 mm by 14 mm were tested to destruction across their width, using an ERWEKA tablet hardness tester THB30. Using this tester the tablet were set on a generally L-shaped support, against the upwardly projecting limb thereof. A circular piston of 8 mm diameter was advanced at a rate of 30 mm per minute and pressed onto the central region of the respective side wall (i.e. one of the sides of size 37 mm by 14 mm), until the tablet was broken.

The Disintegration testing used a Disintegration-Tester ERWEKA 2T 54, operated at 68 strokes per minute. A one-litre glass beaker was used, containing 800 ml tap water at 40° C. The beaker was placed in a water bath to maintain its temperature. Three tablets were placed in a 3-segment basket. The basket was put in the water, the tester was switched on, giving rise to agitation, and a stopwatch started. The time was noted when the basket was empty.

Friability was measured using a Vankel Friabilator machine, model No. 45-2100 and an analytic balance, accurate to 0.01 g. A tablet was placed in the friabilator drum, set for 30 cycles. At each stop point the tablet was reweighed. Percentage loss is calculated as $$\frac{\text{Initial weight} - \text{Final weight}}{\text{Initial weight}} \times 100$$

It can be seen that the unwrapped tablets compressed with low compressive force have good dissolution properties but modest mechanical properties. They are of low hardness and are highly friable; they readily release particulates and have a tendency to crumble easily even under low applied stresses, for example in handling. These deficiencies are much improved by the heat-shrunk wrapping; whilst the excellent dissolution properties are unaffected.

The invention claimed is:

1. A process for the preparation of a package containing a tablet, the process, comprising the steps of:

(a) flow wrapping the tablet with a heat shrinkable, water soluble polymeric film; and, thereafter, (b) heat treating the wrapped tablet at an elevated temperature using a flow of air at an elevated temperature to shrink the film such that it clings to said tablet, wherein the said package is non-friable and wherein the said tablet itself is friable.

2. The process according to claim 1, wherein the heat treatment step (b) is carried out in a time of 0.1 to 5 seconds.

3. The process according to claim 1, wherein the air is heated to a temperature of between 90 to 950° C.

4. The process according to claim 1, wherein in step (b) the film is heated to a temperature of between 80 to 220° C.

5. The process according to claim 1, wherein the film has an aperture to allow the release of any trapped air during step (b).

6. The process according to claim 1, wherein the thickness of the film is 10 to 2000 μm.

7. The process according to claim 1, wherein the film comprises polyvinyl alcohol.

8. The process according to claim 1, wherein the tablet is a fabric care, surface care or dishwashing composition.

9. The process according to claim 1, wherein the process includes the step of: forming the tablet at a compaction pressure in the range 150-400 kg/cm$^2$ to form the tablet.

10. The process according to claim 9, wherein the said package is packaged in an outer non-water soluble container.

11. The process according to claim 1, wherein the said package is quick dissolving in water; quick dissolving meaning that a 20 g package will dissolve in water which is at 40° C. in less that 10 minutes, under conditions of water agitation.

12. The process according to claim 1, wherein the said tablet has a hardness not exceeding 200 N.

* * * * *